US006158621A

United States Patent [19]

Keller

[11] Patent Number: 6,158,621

[45] Date of Patent: Dec. 12, 2000

[54] DEVICE FOR THE USE OF A THIN WALL PACKAGE

[76] Inventor: Wilhelm A. Keller, Obstgartenweg 9, CH-6402 Merlischachen, Switzerland

[21] Appl. No.: 08/997,647

[22] Filed: Dec. 23, 1997

[30] Foreign Application Priority Data

Dec. 24, 1996 [EP] European Pat. Off. ..... 96810904
Sep. 1, 1997 [EP] European Pat. Off. ..... 97810618

[51] Int. Cl.[7] ..... B65D 35/28

[52] U.S. Cl. ..... 222/95; 222/105; 222/137; 222/145.3; 222/145.6; 222/327; 222/387

[58] Field of Search ..... 222/95, 105, 137, 222/145.3, 145.5, 145.6, 326, 327, 386, 387

[56] References Cited

U.S. PATENT DOCUMENTS

| | | | |
|---|---|---|---|
| 4,972,969 | 11/1990 | Randklev | 222/137 |
| 5,332,122 | 7/1994 | Herold et al. | 222/326 |
| 5,647,510 | 7/1997 | Keller | 222/94 |
| 5,667,102 | 9/1997 | Keller | 222/94 |
| 5,697,524 | 12/1997 | Sedlmeier | 222/137 |
| 5,699,935 | 12/1997 | Stahley | 222/137 |

FOREIGN PATENT DOCUMENTS

| | | |
|---|---|---|
| 0 319 666 | 6/1989 | European Pat. Off. . |
| 0 369 723 | 5/1990 | European Pat. Off. . |
| 0 666 823 | 8/1995 | European Pat. Off. . |
| 0 693 437 | 1/1996 | European Pat. Off. . |
| 43 27 755 | 2/1995 | Germany . |
| 92/12798 | 8/1992 | WIPO . |

*Primary Examiner*—Joseph A. Kaufman
*Attorney, Agent, or Firm*—Foley & Lardner

[57] ABSTRACT

The cartridge assembly for dispensing at least one component comprises a cartridge having a rigid cartridge cylinder, a package assembly having a membrane containing liquid chemical, the membrane having a closed inlet end and an outlet end and a piston assembly disposed in said cartridge assembly. The piston side end of the inner wall of the cartridge cylinder and the front of said piston assembly are formed thus that the membrane is turned outside-in within itself by the action of the piston provided with a sealing lip such that the inner surfaces of the turned outside-in wall portions of the membrane are sliding relative to each other during emptying of the package, sealing the gap betweeen the double walls. Such a device requires considerably less dispensing force which is important particularly for a hand driven apparatus, and allows an efficient sealing of the liquid while dispensing.

36 Claims, 8 Drawing Sheets

DEVICE FOR THE USE OF A THIN WALL PACKAGE

BACKGROUND OF THE INVENTION

The present invention refers to a cartridge assembly, comprising a cartridge having a rigid cartridge cylinder, a membrane containing liquid chemical and having a closed end and an outlet end disposed in said cartridge, and a piston assembly, arranged thus, that the membrane is turned outside-in within itself by the action of the piston such that the inner surfaces of the turned outside in wall portions of the membrane slide relative to each other during emptying of the package.

The use of a thin wall plastic film or plastic film/metal foil laminate membrane sausage shaped package to contain and to dispense a chemical such as an adhesive or sealant is well known. The membrane package is placed within a cartridge type container which acts as a mechanical support while the membrane is scraped off the cartridge wall and compacted to expel its content, the cartridge type container being re-usable. Despite the advantage of a considerably reduced package structure for disposal, this above mentioned principle of compacting the package requires a much greater dispensing force in relation to a conventional cartridge due to the force required for scraping off and progressively compacting the foil package from the supporting inner cartridge wall while the package is under significant hydraulic pressure. This issue of force is very important especially for manually actuated dispensing devices where only a limited hand force is available.

As an alternative to the above, European Patent Application No. 369,723 discloses a similar package but with the difference that the membrane is turned outside-in by a plunger, rather than being scraped off the wall under pressure and compacted, which considerably increases the relative mechanical efficiency.

However, this prior art according to the introduction of the independent claims, acknowledges that a leak path of the package content will exist between the two adjacent membrane walls and also that the leak path will be smaller or greater depending upon the clearance between the plunger and the cartridge cylinder internal diameter which determines the gap between the two adjacent membrane walls. Therefore, dependant upon viscosity of the liquid chemical content, the pressure being applied in order to dispense the content and the size of leak path, the effect can be to discharge part of the content of the membrane rearwards past the plunger instead of ahead of the plunger and out of the package, thus disturbing the ratio and increasing waste. This rearwards discharge is the result of leak between the two package membranes adjacent to the plunger and into the trailing membrane package behind the plunger where it will inflate, and may burst, the membrane under pressure.

SUMMARY OF THE INVENTION

Based upon this prior art, a first object of this invention is to overcome the problems of such previously described leak path. This object is solved by the cartridge assembly according to the independent claims.

It is a further object of the invention to ensure the proper initial turning outside-in of the package as well as improving mechanical efficiency.

Further embodiments and improvements are defined in the dependent claims.

BRIEF DESCRIPTION OF THE DRAWINGS

The invention will be explained in more detail hereinafter with reference to a drawing of embodiments.

DETAILED DESCRIPTION OF THE INVENTION

Figure 1A:
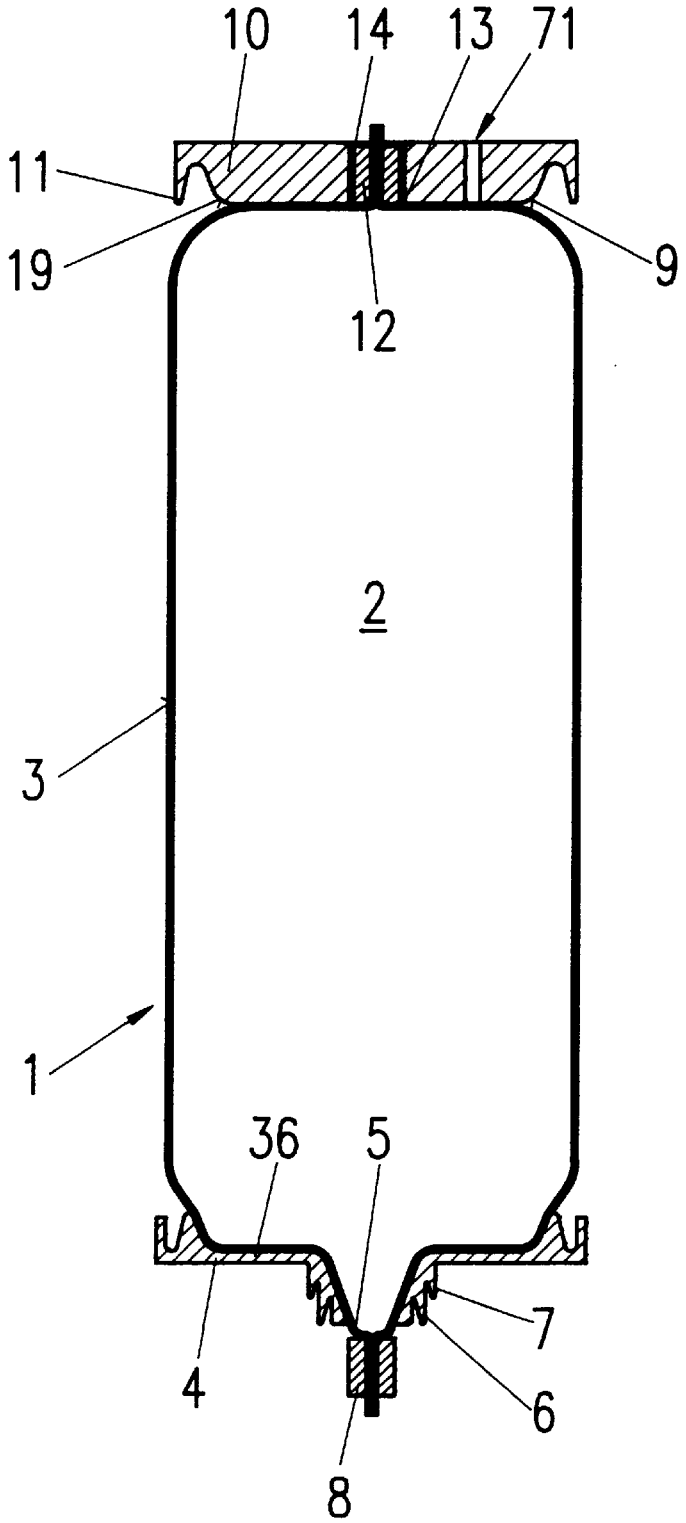
FIG. 1A shows a longitudinal section of a first embodiment of the invention.

The proposed invention, using a piston with a pressure activated sealing lip, offers a considerable improvement over the prior art method of use of a thin membrane sausage type package in that the membrane is not scraped off, collapsed and compacted by the front edge of a plunger while under considerable and adverse hydraulic pressure but instead, the package is progressively emptied and turned outside-in within itself by the piston as it is driven towards the outlet side of the cartridge. As it does so, the membrane of the package is free to be progressively peeled off from the inner wall of the cartridge cylinder behind the piston where no adverse hydraulic pressure exists and is turned over outside-in and trailed behind the piston.

Typical operating backpressures of ten bars or more within the package ensure that the membrane does not slide within the cartridge inner wall and, as part of its function, the piston ensures a seal between the innermost membrane wall and the cartridge inner wall supported outermost membrane wall after the package is turned outside-in within itself. Therefore, while using the principle of a membrane package structure with the prior art advantages of low disposal volume and weight, the proposed invention substantially reduces the dispensing force because the two adjacent material lubricated membrane wall portions, which are subjected to a sealing force provided by a sealing means in the form of the lip of the piston, slide easily relative to each other. Also, there is less material residue after use and the principle allows the repeated re-use of the rigid cartridge tube and the front outlet of the cartridge assembly.

In a further embodiment of the invention the piston is a plunger without any lip sealing means. In order to prevent a leak path between the adjacent membranes therefore, it is necessary to have a minimum gap between the plunger and the cartridge wall. To achieve the latter the plunger must be accurately aligned, in particular at the entry of the plunger, relative to the double walls of the cartridge supported membrane package and the length of the plunger must be at least equal to the length of the double walls of the cartridge supported membrane package after complete displacement action of the plunger. Also, the diameter of the plunger must be substantially equal or less than the inside diameter of the cylinder minus twice the double wall thickness of the membrane.

In both piston and plunger embodiments as above, the withdrawal of the piston or plunger from the partially used package requires that, at the time of withdrawal, a vacuum relief passage allows air to pass through to between the piston or plunger and the package so as to prevent a vacuum from forming and so as to allow the piston to withdraw and the package to remain.

The invention pertains to a cartridge assembly with one cylinder and one package assembly as well as to a cartridge assembly with two or more cylinders having package assemblies with one common cartridge outlet receiving, sealingly, the package outlet adaptors.

The invention is now explained in detail. FIG. 1A shows a longitudinal section of a sausage type thin wall membrane package assembly 1 containing a liquid chemical 2 and comprising a thin, strong and chemical resistant flexible plastic film or plastic film/metal foil laminate membrane 3. The membrane 3 is folded and sealed by a crimped ring 8 and is attached by an adhesive to the content side face of the outlet adaptor 4, the latter having an outlet 5 with two sealing lips 6 and 7 on its outer diameter. The crimped ring 8 sealed end passes through the outlet adaptor 4.

At the opposite and rear end of the package assembly 1, the membrane 3 is folded and sealed by a crimped ring 12 and is being held against the front face 9 of a driven piston 10, having a vacuum relief passage 71 and a female contour 19 comprising a flexible lip 11, by an adhesive such as hot melt 14 while said closed end with crimped ring 12 is positioned and held in a bore 13 within the driven piston 10.

Figure 1B:
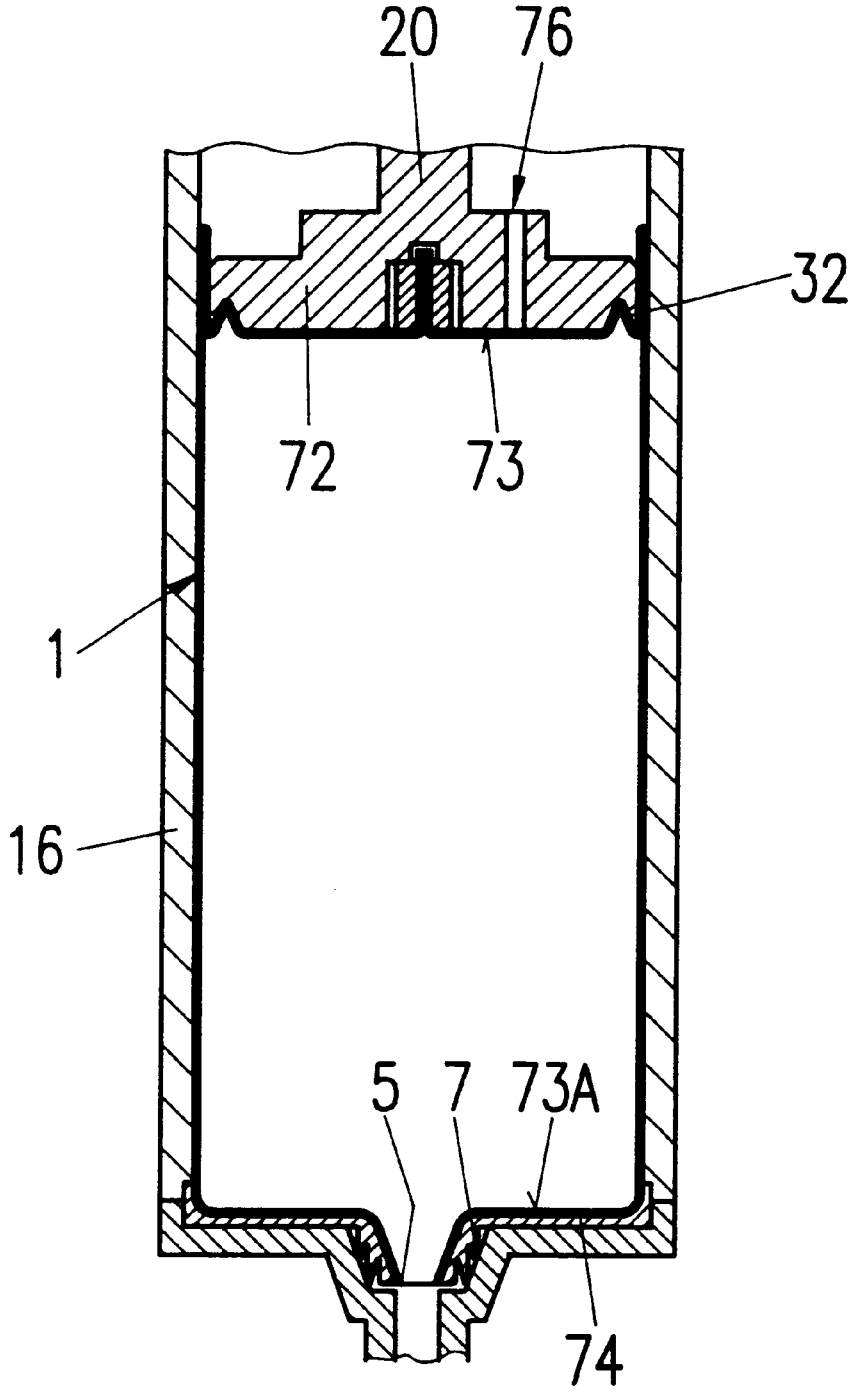
FIG. 1B shows a variant to the embodiment of FIG. 1A, FIGS. 2A and 2B show a longitudinal section of an assembly of the invention with two identical packages of FIG. 1 in different positions within a cartridge.

FIG. 1B shows a package assembly 1 within a cylinder 16, the package assembly 1 being similar to that shown in FIG. 1A but with the difference that the driven piston 72 has no female contour but a flat face 73 opposing the outlet adaptor 74, having a flat face 73A.

Figures 2A, 2B:
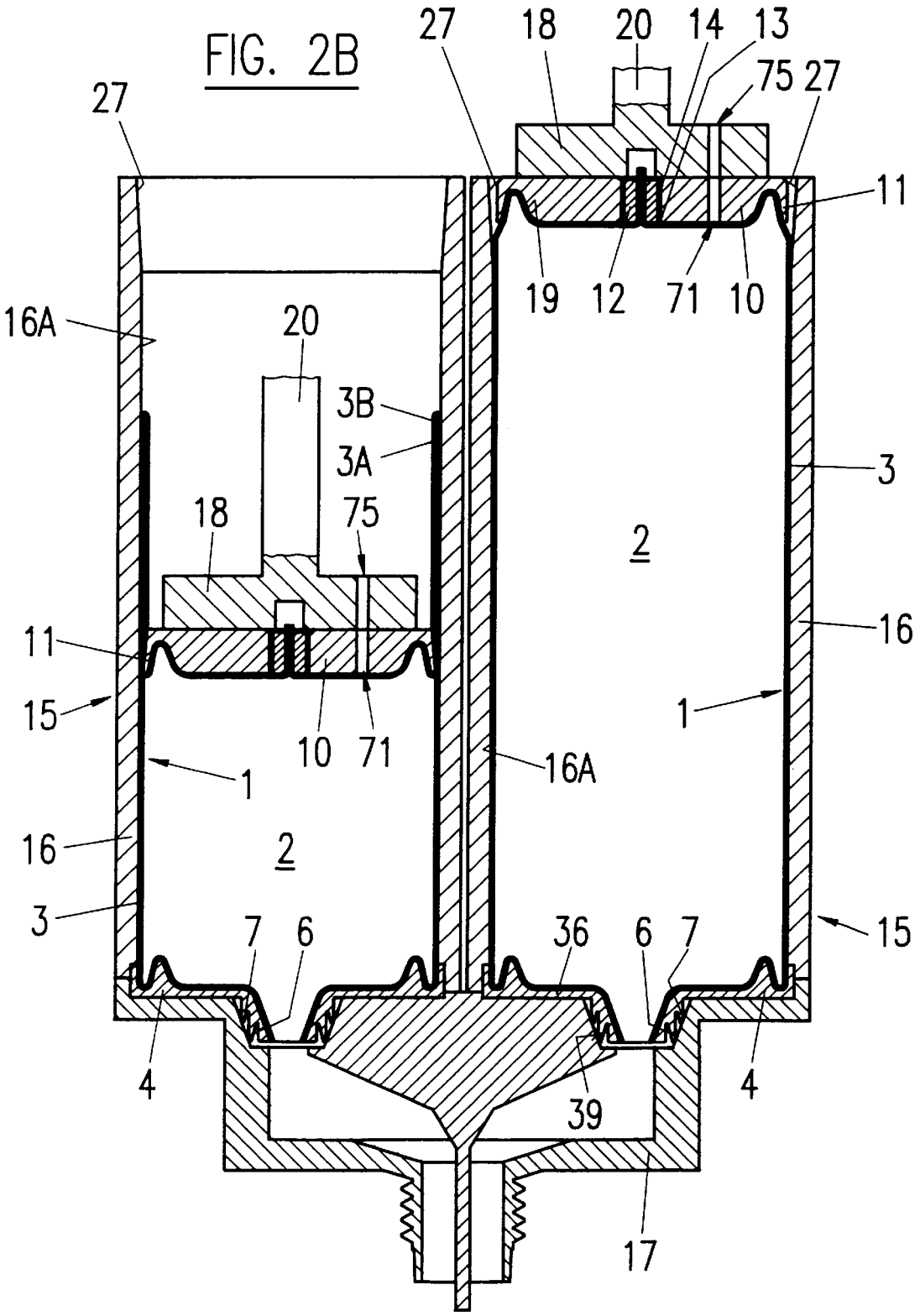

FIGS. 2A and 2B show a longitudinal section of a re-usable cartridge assembly 15 comprising two re-usable pressure resistant cylinders 16 and a common re-usable cartridge outlet 17 within which two identical package assemblies 1 containing liquid chemicals are positioned as shown in FIG. 1 in two different stages of dispensing.

FIG. 2A shows the package assembly 1 just prior to dispensing, with the membrane 3 snugly fitting within the cartridge assembly 15, where the outlet adaptor 4 is positioned and sealed by the two lips 6 and 7, within a tapered bore 39 of the cartridge outlet 17, the front crimped ring 8 having been cut away so as to open the package. Support of the cartridge outlet 17 against forward thrust of the package assembly is not shown. A drive plunger 18 with a vacuum relief passage 71 and with drive rod 20 is shown at the rear of the package assembly 1 with the package under initial pressure via driven piston 10, the membrane 3 now following the inside female contour 19 of the driven piston 10 and its flexible lip 11.

FIG. 2B shows the same components as in FIG. 2A but with the drive rod 20 and drive plunger 18 having moved the driven piston 10 forward approximately halfway down the package assembly 1. The membrane 3 is under hydraulic pressure against the inside of the flexible lip 11 of the driven piston 10 and presses that lip 11 and the two thus formed material-side membrane wall portions 3A and 3B against the cylinder inside wall 16A to form a seal between the two material lubricated inner surfaces of the membrane wall portions 3A and 3B in order to prevent the liquid chemical 2 leaking past that seal. During the dispensing operation, the membrane wall portion 3B slides relatively to the stationary membrane wall portion 3A.

In FIGS. 2A and 2B the cartridge cylinder 16 has an inside taper 27 at the open end such that, under initial pressure, the membrane 3 may expand in diameter to the extent of the inside wall of that taper thus allowing the front of driven piston 10, comprising the flexible lip 11, to push the membrane within itself and therefore outside-in and creating the membrane wall portions 3A and 3B, the inner surfaces thereof sliding relative to each other.

While the package is progressively emptied, the membrane 3 is peeled off the cartridge wall 16A behind the driven piston and trails the driven piston 10. During the dispensing process, the cartridge outlet 17 acts as a support against the forward thrust of the whole package assembly 1 within the cartridge assembly 15. The cartridge supporting device is not shown.

Figure 3:
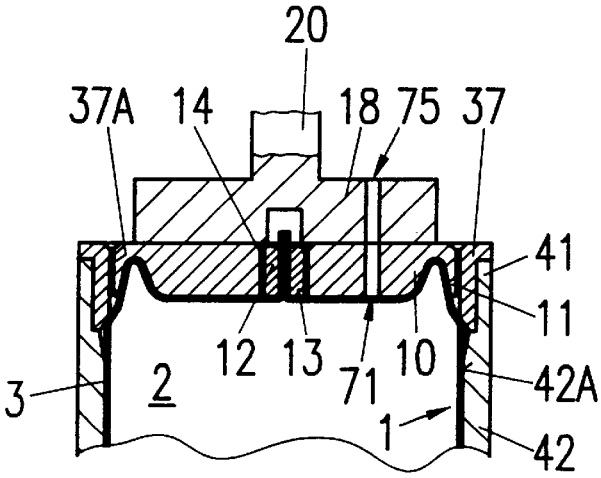
FIG. 3 shows a variant of the rear part of the embodiment of FIG. 2A.

In order to ensure the outside-in function of the membrane and as shown on FIG. 3, it is advantageous to align the driven piston 10 with its flexible lip 11 concentrically relative to the cartridge cylinder inside wall 42A and therefore the package assembly 1. Such an alignment means, in the form of an insert 37 which is set within the stepped and/or tapered end 41 of cartridge cylinder 42, guides and aligns the driven piston 10. The inner diameter 37A of the insert 37 centers the driven piston 10 relative to the cartridge cylinder inside wall 42A and package assembly 1 and restricts the outer diameter of the flexible lip 11 such that during the initial phase of dispensing it will push the end surface of membrane 3, which is in contact with the front side of the piston, ahead so as to enter the cylinder wall supported membrane package and turn the membrane outside-in within itself.

Figure 3A:
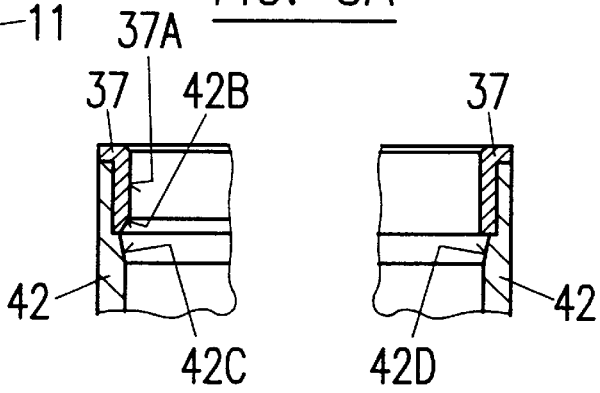
FIG. 3A shows a detail of the inlet end of the cartridge.

In FIG. 3A the inner diameter 37A and passage dimension of the alignment means insert 37, which need not necessarily be a ring or circular, is equal or smaller than the cartridge cylinder inside wall 42 or package membrane 3. Adjacent to the outlet side end of the insert 37 is a section of the cylinder inside wall 42C which is equal or larger in diameter than the inside diameter of the cylinder wall 42 for initiating the outside-in function. The outlet end of the insert 37 can have a transition taper 42B as well as the cartridge inner wall at 42C, or only the cartridge inner wall is tapered at 42D, as shown on the right side of cartridge wall 42 in FIG. 3A.

Figure 4:
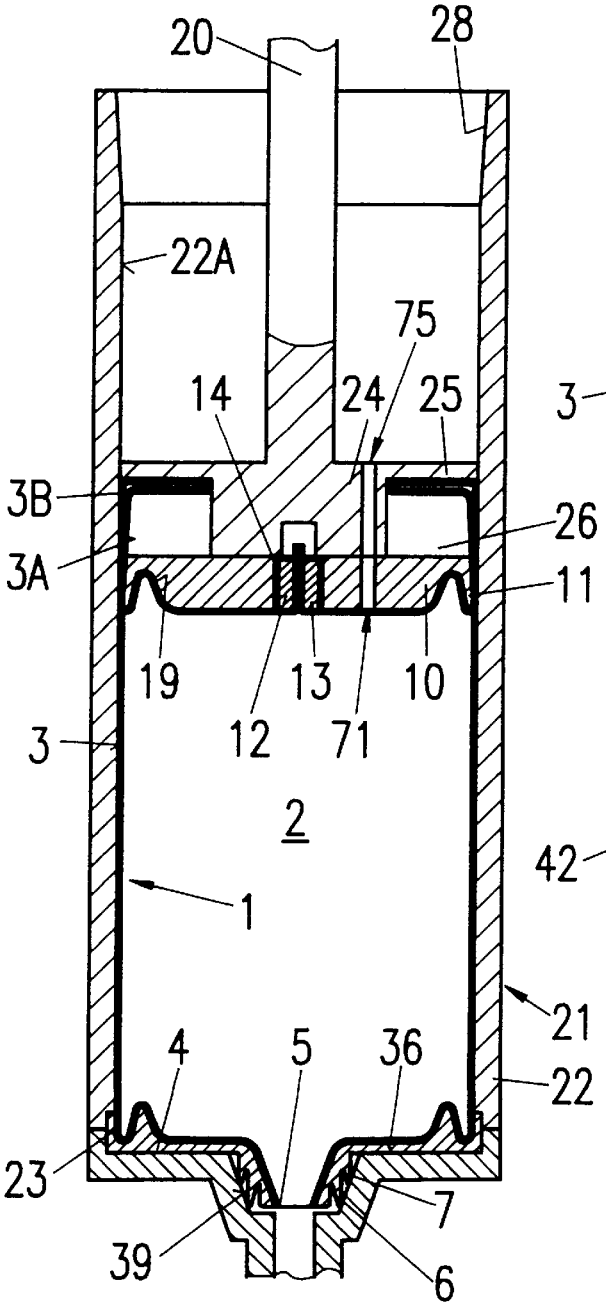
FIG. 4 shows a longitudinal section of a variant of the embodiment of FIG. 1.

FIG. 4 shows a variant to the embodiment described in FIG. 2B, whereby a package assembly 1 is contained within a cartridge assembly 21 having a cylinder 22 with inner wall 22A and taper 28, and a cartridge outlet 23, receiving the outlet 5 of outlet adaptor 4. The driven piston 10 with vacuum relief passage 71 and lip 11 is driven by a drive rod 20 driving a compacting plunger 24 with vacuum passage 75 having a smaller front diameter and a larger disc like rear portion 25 compacting wall portions 3A and 3B of membrane 3 within the annular space 26 as it trails behind the driven piston 10. The same vacuum relief passages 71 and 75 are as shown in FIG. 3.

Figure 5B:
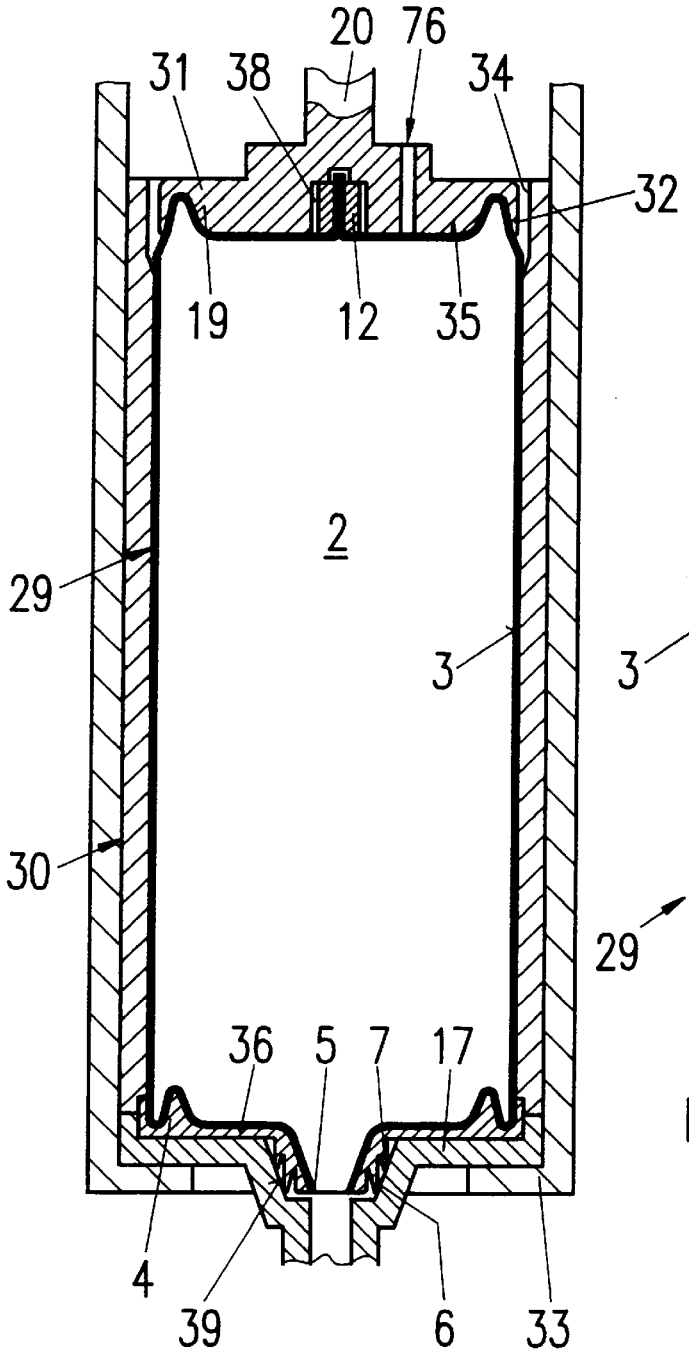
FIG. 5B shows a longitudinal section of an assembly of the second embodiment of the invention.
Figure 5A:
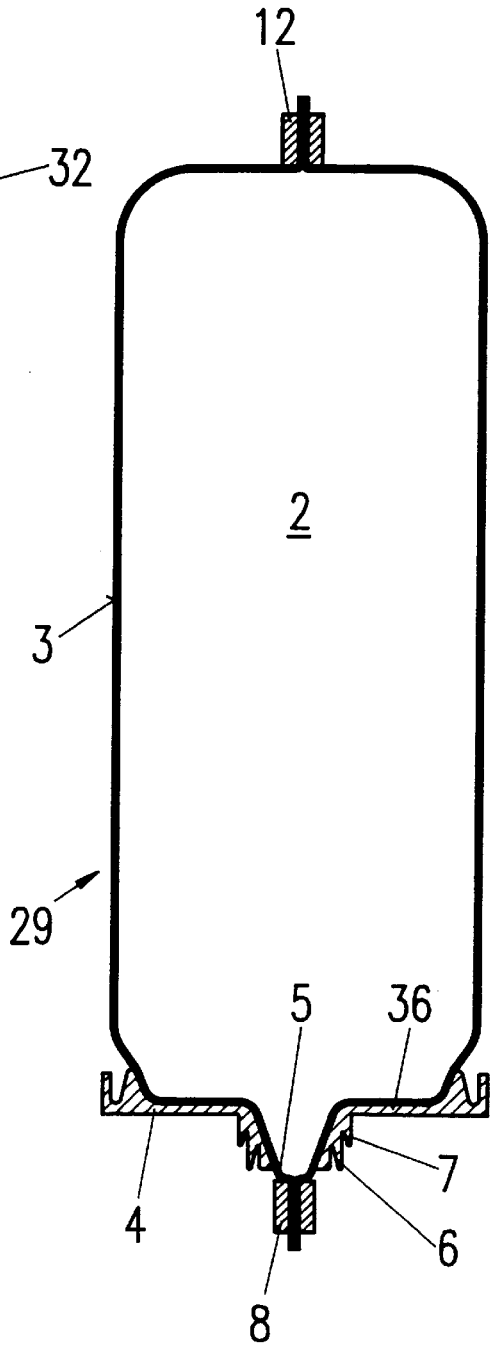
FIG. 5A shows a longitudinal section of a package of a second embodiment of the invention.

FIG. 5A shows a package assembly 29 containing liquid chemical 2, similar to that as previously described in FIG. 1, with the same outlet adaptor 4, outlet 5 with sealing lips 6 and 7 and crimped ring 8, but without the driven piston 10 attached to laminate foil package.

FIG. 5B shows the package assembly 29 of FIG. 5A within a cartridge assembly 30 just prior to dispensing but, unlike FIGS. 2A, 2B, 3 and 4, the drive piston 31 with vacuum relief passage 76 is directly connected to the drive rod 20 and functions as does the driven piston 10 with lip 11 in FIGS. 2A, 2B and 3 by virtue of having a lip 32. The drive piston 31 is axially aligned relative to the package assembly 29 within the cartridge assembly 30 via drive rod 20 and a support frame 33. The drive piston 31 comprises, at its center, a cavity 38 for receiving the end closed by crimped ring 12 of the package assembly 29.

The cartridge assembly 30 is similar to the cartridge assembly 21 of FIG. 4 with the difference that the piston side end of the cylinder 22 has an enlarged diameter section 34 with a transition taper in between having the same effect as taper 27 or 28 of the previous embodiments for allowing the expansion of membrane 3 to that greater diameter, therefore allowing the piston to push the membrane package within itself and outside-in. Similar to the driven piston 10, drive piston 31 with vacuum relief passage 76 and lip 32 has an inner contour 35.

The outlet adaptor 4, as shown in FIGS. 1 to 5, has on its membrane-side a male contour 36 to fit closely against the female contour counterpart 19 or 35 of the driven piston 10 as well as that of the drive piston 31, FIG. 5B, so as to ensure the complete discharging of the material 2 from the package assembly. The male contour 36 requires that the outer diameter of the outlet adaptor 4 is larger than the inside diameter of the cylinder wall 16A such that the outlet adaptor 4 is retained and centered between the wall of cylinder 16 and the cartridge outlet 17.

FIGS. 1 to 5 show outlet adaptor 4, with lips 6 and 7, which retains and seals the package between the outlet adaptor 4 and the re-usable cartridge outlet 17, 23 and centers the outlet adaptor 4 relative to the cartridge cylinder 16, 22, 30 and the cartridge outlet 17 as well as providing a male contour 36 to match the female contours 19, 35 on the driven pistons 10, resp. on the drive piston 31.

Figure 6:
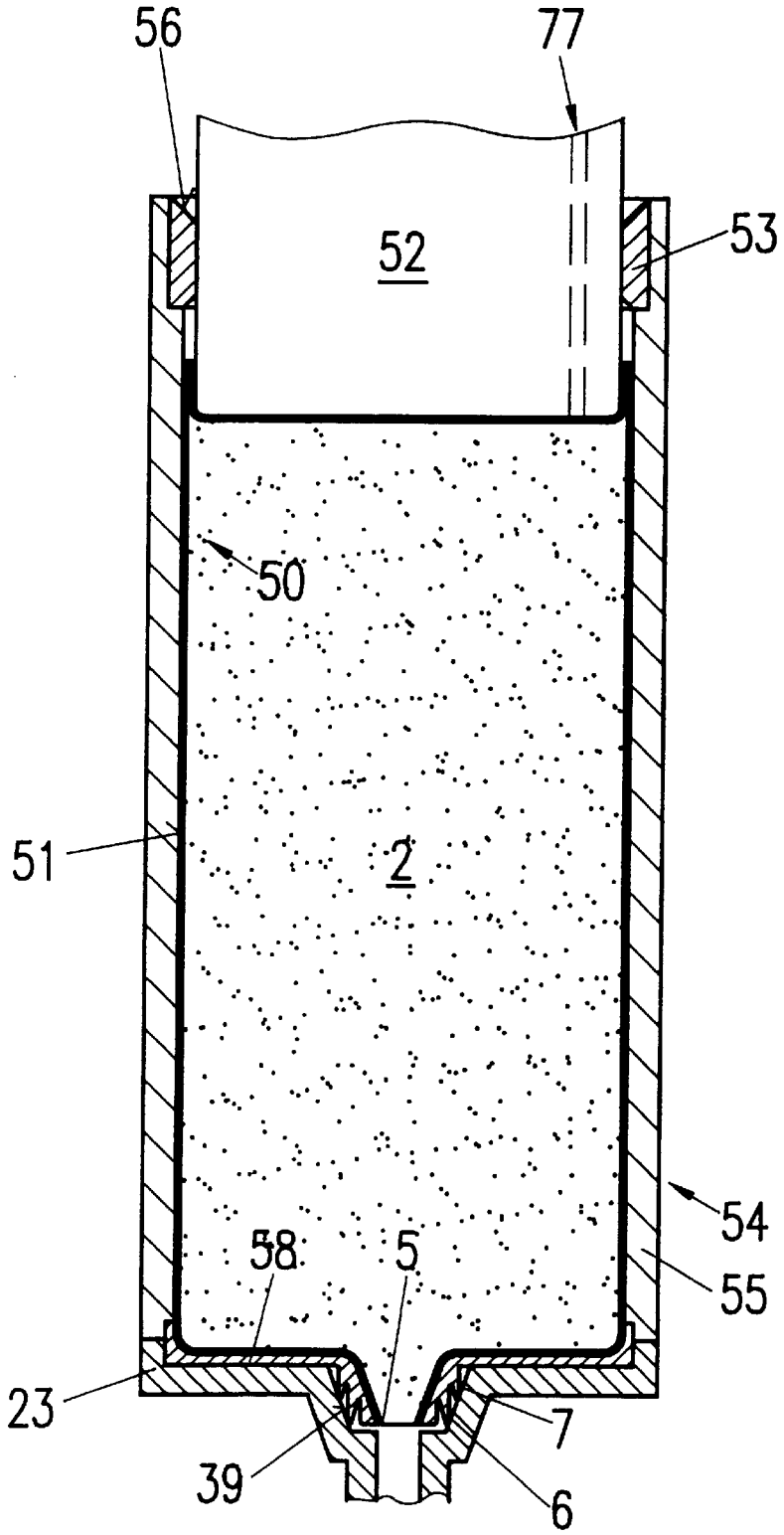
FIG. 6 shows a longitudinal section of a third embodiment of the invention with a plunger without sealing means in a first position.
Figure 7:
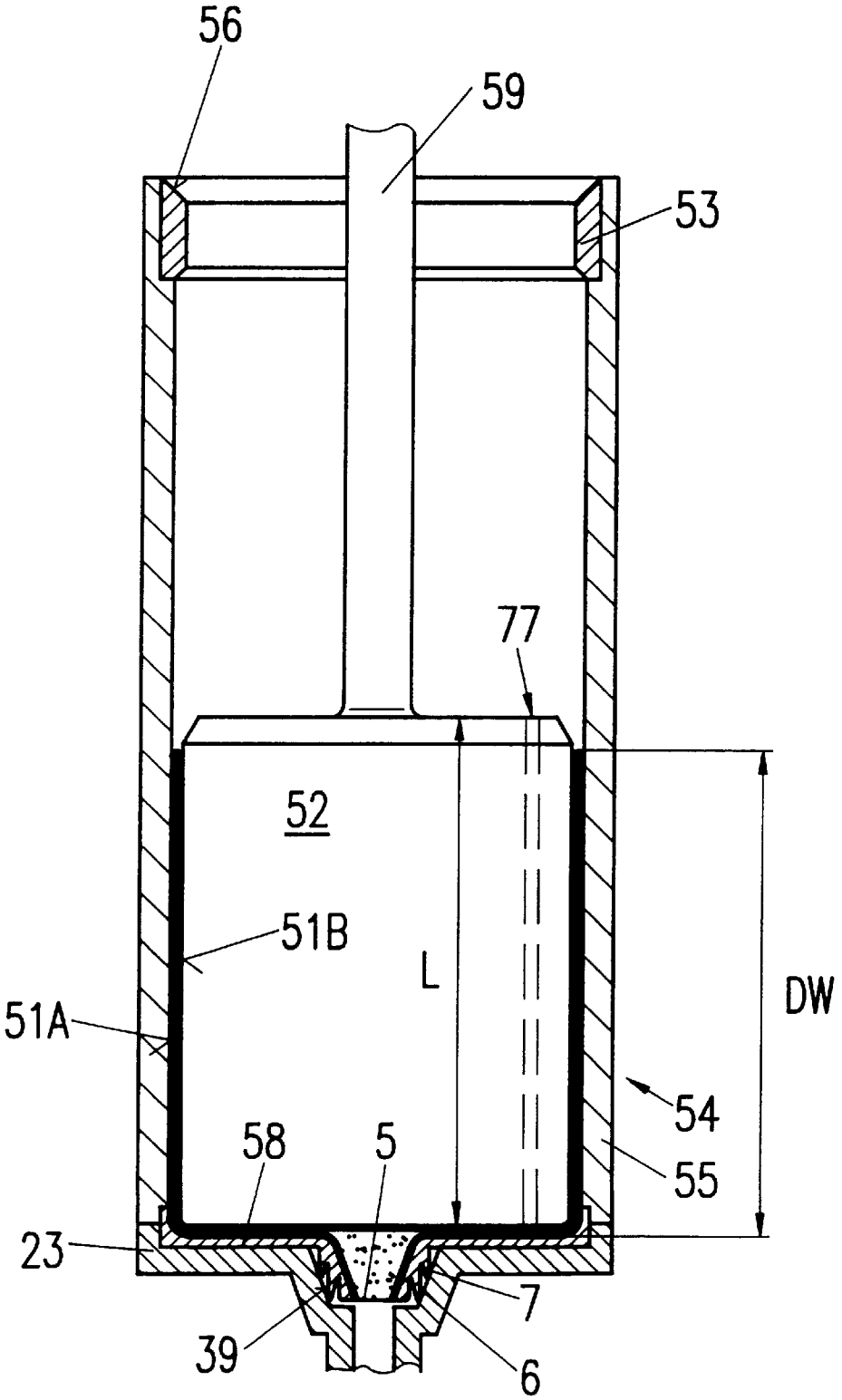
FIG. 7 shows the embodiment of FIG. 6 in a second position of the plunger.
Figure 8:
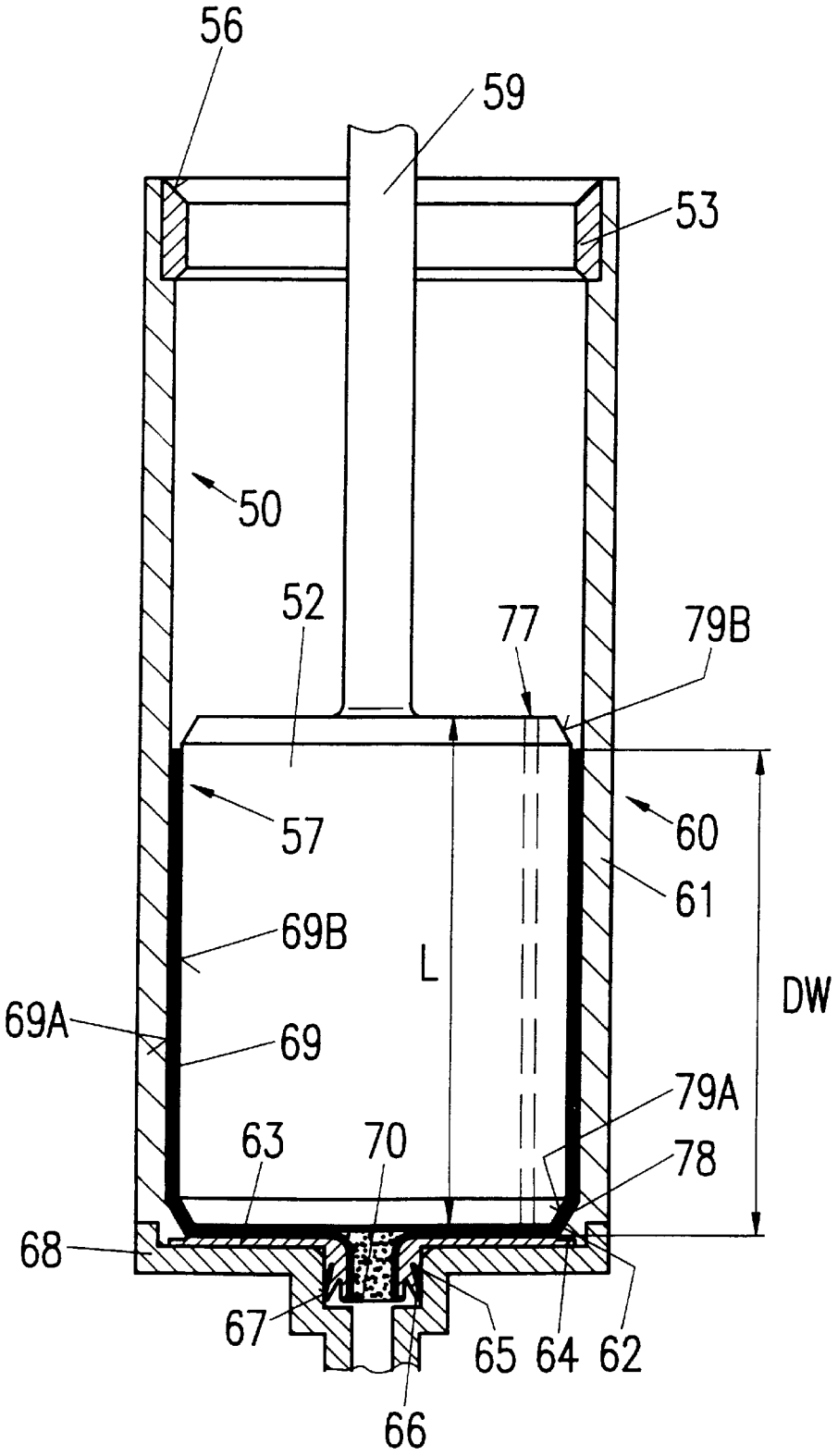
FIG. 8 shows a further embodiment of the invention in the same position as shown in FIG. 7.

FIGS. 6 to 8 show further embodiments with a plunger 52 having no lip sealing means. FIG. 6 shows a longitudinal section of a package assembly 50 containing a liquid chemical 2 and comprising the membrane 51 fitting within the cartridge assembly. The plunger 52 with vacuum relief passage 77 is shown having entered an inlet adaptor 53 in the cartridge assembly 54. The inlet adaptor 53 can be a ring inserted into the cartridge wall 55 or it can consist of at least three centering ribs moulded integrally with the cartridge wall. The inlet adaptor 53 has at its inlet end a chamfer 56 and has an inner diameter which is slightly larger than the plunger. The inlet adaptor 53 forms a plunger entry alignment chamfer, with the plunger aligning coaxially within the cartridge assembly 54 and the flexible membrane 51.

The outlet end of the membrane 51 is attached to an outlet adaptor 58 similar to the outlet adaptor 4 of the previous embodiments, whereby the inner face of the outlet adaptor and the bottom face of the plunger are flat. The cartridge can be provided with the same cartridge outlet 23 as according to FIG. 4 and with the tapered bore 39.

FIG. 7 shows the same components as FIG. 6 but after displacement of the liquid chemical through the outlet 5.

For proper functioning, the length L of the plunger must be equal to or greater than the length DW of the double walls 51A, 51B of the cartridge supported membrane package 51 after complete displacement of the content by the plunger, as shown in FIG. 7. The diameter of the plunger must be, as near as technically possible, substantially the same or smaller than the inner diameter of the cartridge cylinder minus twice the double thickness of the membrane.

FIG. 8 shows another embodiment of the invention similar to FIG. 7 with the same parts having the same function and numerals. The cartridge assembly 60 contains a membrane package assembly 57 comprising the outside-in turned membrane 69 with the double walls 69A and 69B. Plunger 52 is shown to have a tapered front section 79A as well as a tapered rear section 79B to ensure plunger 52 entry and exit alignment via inlet adaptor 53.

In deference to the previously shown embodiments, cylinder wall 61 is provided with an inside collar 62 at the end of the cylindrical section for retaining a shoulder 64 at the outlet adaptor 63, the collar enabling a radius or taper for a smoother transition of the membrane 69 from the cylindrical section to the front face, whereby the taper and/or radius of the collar matches the taper and/or radius of the plunger 52 front section.

The collar 62 at the end of the cylindrical section of the cartridge wall and the shoulder 64 at the outlet adaptor is not only advantageous in connection with a plunger type assembly as shown in FIGS. 6 to 8 but also, in connection with the embodiments, having a piston with sealing means, and also with any other outlet adaptor means.

The same applies to the outlet variant shown in FIG. 8 whereby the outside of outlet 70 of outlet adaptor 63 is cylindrical and provided with sealing lips 65 and 66 similar to sealing lips 6 and 7, and fitting within a cylindrical outlet 67 of the cartridge outlet 68.

What is claimed is:

1. A cartridge assembly for dispensing at least one component, comprising:

a rigid cartridge unit having a piston inlet end and an outlet;

a package assembly including a membrane and an outlet adaptor the membrane containing liquid chemical, the membrane having a closed end and an outlet end attached to the outlet adaptor, the membrane being disposed in the cartridge unit and the outlet adaptor being mounted to the cartridge outlet, the outlet adaptor having at least one sealing element on an outer diameter thereof for sealingly engaging the cartridge outlet; and a piston assembly arranged to be slidably received in the cartridge unit and to contact the closed end of the membrane to turn outside-in wall portions of the membrane from the closed end toward the outlet end, the wall portions sliding relative to each other during emptying of the membrane, the piston assembly including a piston with a sealing element that cooperates with an inner wall of the cartridge unit at the piston inlet end of the cartridge unit to seal gaps between the sliding wall portions of the membrane.

2. A cartridge assembly according to claim 1, wherein an inner diameter of the piston inlet end of the cartridge unit is larger than an inner diameter of a remaining part of the cartridge unit.

3. A cartridge assembly according to claim 2, wherein the piston inlet end is tapered.

4. A cartridge assembly according to claim 2, wherein an inner wall of the cartridge unit has a step at the piston inlet end and a transition taper between the step and the remaining part of the inner wall of the cartridge unit.

5. A cartridge assembly according to claim 1, wherein the piston has a vacuum relief passage.

6. The cartridge assembly of claim 5, further comprising an inlet adaptor mounted to the inner wall of the cylinder unit adjacent the plunger inlet end, the inlet adaptor having a taper and a passage for centering the plunger relative to the cartridge unit, the taper of the inlet adaptor aligning entry of the plunger into the cartridge unit.

7. A cartridge assembly according to claim 1, wherein the sealing element consists of at least one pressure actuated sealing lip.

8. A cartridge assembly according to claim 7, wherein the cartridge outlet has a tapered or cylindrical bore for receipt of the sealing element.

9. A cartridge assembly according to claim 1, further comprising another cartridge unit, another package assembly, another piston assembly, and wherein the cartridge outlet comprises a common cartridge outlet for receipt of the outlet ends of the package assemblies.

10. A cartridge assembly according to claim 1, wherein the piston assembly includes the piston, a drive plunger for driving the piston and a drive rod.

11. A cartridge assembly according to claim 10, wherein the drive plunger has a front face that faces the piston and a disc shaped rear portion of a larger diameter than the front face, and the wall portions of the membrane are compacted between the piston and the disc shaped rear portion of the drive plunger.

12. A cartridge assembly according to claim 10, wherein the piston is independent of the package assembly and the package assembly is attached to and driven by the drive rod.

13. A cartridge assembly according to claim 10, wherein the piston and the drive plunger each have a vacuum relief passage.

14. A cartridge assembly according to claim 1, wherein a contour of a side of the piston that faces the outlet adaptor matches a contour of a side of the outlet adaptor that faces the piston.

15. A cartridge assembly according to claim 1, wherein an outer diameter of the outlet adaptor is greater than an inner diameter of the inner wall of the cartridge unit, and the outlet adaptor is centered and retained between the cartridge unit and the cartridge outlet.

16. A cartridge assembly according to claim 1, wherein the cartridge unit defines a collar at the cartridge outlet, and the outlet adaptor has a shoulder that rests against the collar.

17. A cartridge assembly according to claim 16, wherein the collar tapers inward toward the outlet end of the cartridge unit.

18. A cartridge assembly according to claim 1, further comprising an insert mounted to the piston inlet end of the cartridge unit for centering the piston assembly in the cartridge unit, the insert having an inner diameter that is equal to or less than an inner diameter of the cartridge unit and an outer diameter of the membrane.

19. A cartridge assembly for dispensing at least one component, comprising:

a rigid cartridge unit having a piston inlet end and an outlet;

a package assembly including a membrane and an outlet adaptor, the membrane containing liquid chemical, the membrane having a closed end and an outlet end attached to the outlet adaptor, the membrane being disposed in the cartridge unit and the outlet adaptor being mounted to the cartridge outlet, the outlet adaptor having at least one sealing element on an outer diameter thereof for sealingly engaging the cartridge outlet; and a piston assembly having a sealing lip and arranged to be slidably received in the cartridge unit and to contact the closed end of the membrane to turn outside-in wall portions of the membrane from the closed end toward the outlet end, the wall portions sliding relative to each other during emptying of the membrane; and an insert mounted to the piston inlet end of the cartridge unit for centering the piston assembly in the cartridge unit, the insert having an inner diameter that is equal to or less than an inner diameter of the cartridge unit and an outer diameter of the membrane.

20. A cartridge assembly according to claim 19, wherein an inner diameter of the piston inlet end of the cartridge unit is larger than an inner diameter of a remaining part of the cartridge unit, and an inner wall of the cartridge unit includes at least one transition taper between the piston inlet end and a part of the inner wall of uniform diameter.

21. A cartridge assembly according to claim 19, wherein the piston has a vacuum relief passage.

22. A cartridge assembly according to claim 19, further comprising another cartridge unit, another package assembly, another piston assembly, and wherein the cartridge outlet comprises a common cartridge outlet for receipt of the outlet ends of the package assemblies.

23. A cartridge assembly according to claim 22, wherein the cartridge outlet has a tapered or cylindrical bore for receipt of the sealing element.

24. A cartridge assembly according to claim 19, wherein the piston assembly includes the piston, a drive plunger for driving the piston, and a drive rod.

25. A cartridge assembly according to claim 19, wherein a contour of a side of the piston that faces the outlet adaptor matches a contour of a side of the outlet adaptor that faces the piston.

26. A cartridge assembly according to claim 19, wherein an outer diameter of the outlet adaptor is greater than an inner diameter of the inner wall of the cartridge unit, and the outlet adaptor is centered and retained between the cartridge unit and the cartridge outlet.

27. A cartridge assembly according to claim 19, wherein the cartridge unit defines a collar at the cartridge outlet, and the outlet adaptor has a shoulder that rests against the collar.

28. A cartridge assembly for dispensing at least one component, comprising:

a rigid cartridge unit having a plunger inlet end and an outlet;

a package assembly including a membrane and an outlet adaptor, the membrane containing liquid chemical, the membrane having a closed end and an outlet end attached to the outlet adaptor, the membrane being disposed in the cartridge unit and the outlet adaptor being mounted to the cartridge outlet, the outlet adaptor having at least one sealing element for sealingly engaging the cartridge outlet; and a plunger arranged to be slidably received in the cartridge unit and to contact the closed end of the membrane to turn outside-in wall portions of the membrane from the closed end toward the outlet end, the wall portions sliding relative to each other during emptying of the membrane, wherein a length of the plunger is equal or greater than one-half a length of the membrane.

29. A cartridge assembly according to claim 28, wherein a front section of the plunger is tapered.

30. A cartridge assembly according to claim 28, wherein the the plunger has a vacuum relief passage.

31. A cartridge assembly according to claim 28, further comprising another cartridge unit, another package assembly, another piston assembly, and wherein the cartridge outlet comprises a common cartridge outlet for receipt of the outlet ends of the package assemblies.

32. A cartridge assembly according to claim 31, wherein the cartridge outlet has a tapered or cylindrical bore for receipt of the sealing element.

33. A cartridge assembly according to claim 28, wherein an outer diameter of the outlet adaptor is greater than an inner diameter of the inner wall of the cartridge unit and is centered and retained between the cartridge unit and the cartridge outlet.

34. A cartridge assembly according to claim 28, wherein the cartridge unit defines a collar at the cartridge outlet, and the outlet adaptor has a shoulder that rests against the collar.

35. A cartridge assembly according to claim 34, wherein the collar tapers inward toward the outlet end of the cartridge unit.

36. A cartridge assembly according to claim 35, wherein a front face of the plunger includes a taper, and the taper of the collar matches the taper of the plunger.

* * * * *